US009815102B2

(12) United States Patent
Robbins

(10) Patent No.: US 9,815,102 B2
(45) Date of Patent: Nov. 14, 2017

(54) EXTRUSION PRESS CONTAINER AND MANTLE FOR SAME

(71) Applicant: Exco Technologies Limited, Markham (CA)

(72) Inventor: Paul Henry Robbins, Port Perry (CA)

(73) Assignee: EXCO TECHNOLOGIES LIMITED, Markham (CA)

( * ) Notice: Subject to any disclaimer, the term of this patent is extended or adjusted under 35 U.S.C. 154(b) by 0 days.

(21) Appl. No.: 14/135,795

(22) Filed: Dec. 20, 2013

(65) Prior Publication Data

US 2014/0174143 A1 Jun. 26, 2014

Related U.S. Application Data

(60) Provisional application No. 61/745,121, filed on Dec. 21, 2012.

(51) Int. Cl.
*B21C 29/02* (2006.01)
*B21C 27/00* (2006.01)

(52) U.S. Cl.
CPC ..... *B21C 29/02* (2013.01); *B21C 27/00* (2013.01)

(58) Field of Classification Search
CPC ..... B21C 29/02; B21C 27/00; B21C 29/00; B21C 23/21; B21C 23/212; B21C 23/215; B29C 47/0016; B29C 47/8815
USPC ..... 72/342.7–342.92
See application file for complete search history.

(56) References Cited

U.S. PATENT DOCUMENTS

| | | | | |
|---|---|---|---|---|
| 3,042,195 A | | 7/1962 | Muller | |
| 3,360,975 A | * | 1/1968 | Edgecombe | 72/272 |
| 5,802,905 A | | 9/1998 | Biswas et al. | |

FOREIGN PATENT DOCUMENTS

| | | | | |
|---|---|---|---|---|
| CN | 202185474 U | * | 4/2012 | B21C 29/02 |
| DE | 4242395 A1 | | 6/1994 | |
| DE | 20117589 U1 | * | 2/2002 | |
| DE | 20117589 U1 | | 4/2002 | |
| DE | 20318917 U1 | * | 2/2004 | B21C 29/02 |
| DE | 10320014 A1 | | 12/2004 | |
| GB | 765496 A | | 1/1957 | |
| JP | 2010115664 A | * | 5/2010 | B21C 29/02 |
| KR | 101007663 B1 | | 1/2011 | |

OTHER PUBLICATIONS

Machine translation for CN202185474U is attached.*
Faxes of proposed claims for discussion only from applicant received on May 3, 2016 and May 11, 2016 are attached.*
Machine translation for DE 20318917 U1 is attached.*
Machine translation for CN 202185474 U is attached.*
Machine translation for JP 2010115664 A is attached.*

* cited by examiner

*Primary Examiner* — Peter DungBa Vo
*Assistant Examiner* — John S Lowe
(74) *Attorney, Agent, or Firm* — Young Basile Hanlon & MacFarlane, P.C.

(57) ABSTRACT

A container for use in a metal extrusion press comprises a mantle having an elongate body comprising an axial bore, an elongate liner accommodated within the axial bore, the liner comprising a longitudinally extending passage through which a billet is advanced, and a fluid channel in thermal communication with the mantle through which a fluid for cooling the container flows.

10 Claims, 11 Drawing Sheets

EXTRUSION PRESS CONTAINER AND MANTLE FOR SAME

CROSS-REFERENCE TO RELATED APPLICATION

This application claims the benefit of provisional U.S. application Ser. No. 61/745,121 filed on Dec. 21, 2012, the content of which is incorporated herein by reference in its entirety.

FIELD OF THE INVENTION

The present invention relates generally to extrusion and in particular, to an extrusion press container and a mantle for same.

BACKGROUND OF THE INVENTION

Metal extrusion presses are well known in the art, and are used for forming extruded metal products having cross-sectional shapes that generally conform to the shape of the extrusion dies used. A typical metal extrusion press comprises a generally cylindrical container having an outer mantle and an inner tubular liner. The container serves as a temperature controlled enclosure for a billet during extrusion. An extrusion ram is positioned adjacent one end of the container. The end of the extrusion ram abuts a dummy block, which in turn abuts the billet allowing the billet to be advanced through the container. An extrusion die is positioned adjacent the opposite end of the container.

During operation, once the billet is heated to a desired extrusion temperature (typically 800-900° F. for aluminum), it is delivered to the extrusion press. The extrusion ram is then activated to abut the dummy block thereby advancing the billet into the container and towards the extrusion die. Under the pressure exerted by the advancing extrusion ram and dummy block, the billet is extruded through the profile provided in the extrusion die until all or most of the billet material is pushed out of the container, resulting in the extruded product.

In order to attain cost-saving efficiency and productivity in metal extrusion technologies, it is important to achieve thermal alignment of the extrusion press. Thermal alignment is generally defined as the control and maintenance of optimal running temperature of the various extrusion press components. Achieving thermal alignment during production of extruded product ensures that the flow of the extrudable material is uniform, and enables the extrusion press operator to press at a higher speed with less waste.

As will be appreciated, optimal billet temperature can only be maintained if the container can immediately correct any change in the liner temperature during the extrusion process, when and where it occurs. Often all that is required is the addition of relatively small amounts of heat to areas that are deficient.

A number of factors must be considered when assessing the thermal alignment of an extrusion press. For example, the whole of the billet of extrudable material must be at the optimum operating temperature in order to assure uniform flow rates over the cross-sectional area of the billet. The temperature of the liner in the container must also serve to maintain, and not interfere with, the temperature profile of the billet passing therethrough.

Achieving thermal alignment is generally a challenge to an extrusion press operator. During extrusion, the top of the container usually becomes hotter than the bottom. Although conduction is the principal method of heat transfer within the container, radiant heat lost from the bottom surface of the container rises inside the container housing, leading to an increase in temperature at the top. As the front and rear ends of the container are generally exposed, they will lose more heat than the center section of the container. This may result in the center section of the container being hotter than the ends. As well, the temperature at the extrusion die end of the container tends to be slightly higher compared to the ram end, as the billet heats it for a longer period of time. These temperature variations in the container affect the temperature profile of the liner contained therein, which in turn affects the temperature of the billet of extrudable material. The temperature profile of the extrusion die generally conforms to the temperature profile of the liner, and the temperature of the extrusion die affects the flow rate of extrudable material therethrough. Although the average flow rate of extrudable material through the extrusion die is governed by the speed of the ram, flow rates from hotter sections of the billet will be faster compared to cooler sections of the billet. The run-out variance across the cross-sectional profile of a billet can be as great as 1% for every 5° C. difference in temperature. This can adversely affect the shape of the profile of the extruded product. Control of the temperature profiles of the liner and of the container is therefore of great importance to the efficient operation of the extrusion process.

One approach to achieving such temperature profile control of the liner and the container involves introducing cooling to the container. Cooling in extrusion press containers has been previously described. For example, U.S. Pat. No. 5,678,442 to Ohba et al. discloses an extruder having a cylindrical container into which a billet is loaded; a two-piece seal block disposed on an end surface of the container at an extruding stem side; a vacuum deaerating hole formed in the seal block; and a fixed dummy block, having an internal cooling function, fixed to an end of the extruding stem, wherein the seal block is allowed to be opened and closed in a direction perpendicular to the axial direction of the container and the seal block comes in close contact with an outer surface of the extruding stem and the end surface of the container when the seal block is closed.

U.S. Pat. No. 4,829,802 to Baumann discloses an apparatus comprising a region of an extrusion chamber immediately ahead of an extrusion die that is cooled by placing a cooling ring between the bore of an extrusion cylinder in which a ram piston operates. The cooling ring may be a unitary structure, or a multi-part structure, in which an independent inner ring is located within the cooling ring. For mechanical strength, a prestressing outer ring is shrink-fitted around the cooling ring. The outer ring is retained, for example by screws, on a cylinder within which the extrusion chamber is located. The cooling fluid may be water, a vaporizable liquid, or a gas, and is separated from the billet within the extrusion chamber.

Improvements are generally desired. It is therefore an object at least to provide a novel extrusion press container and a mantle for same.

SUMMARY OF THE INVENTION

In one aspect, there is provided a container for use in a metal extrusion press, the container comprising: a mantle having an elongate body comprising an axial bore; an elongate liner accommodated within the axial bore, the liner comprising a longitudinally extending passage through which a billet is advanced; and a fluid channel in thermal communication with the mantle through which a fluid for cooling the container flows.

The fluid channel may comprise at least one groove formed in the outer surface of the mantle. The at least one groove may be a serpentine groove. The mantle may have a generally cylindrical shape, and at least a portion of the at least one groove may extend in a circumferential direction. The fluid channel may further comprise a cover plate covering the at least one groove.

The container may further comprise a fluid guide configured for one or more of: directing fluid into the fluid channel, and directing fluid out of the fluid channel.

The fluid channel may be adjacent a die end of the container. The fluid channel may be adjacent an upper portion of the container.

The fluid may be a gas. The gas may be air.

The mantle may be configured for connecting to an extrusion press.

In another aspect, there is provided a mantle for an extrusion press container, the mantle comprising: an elongate body comprising an axial bore for accommodating a liner through which a billet is advanced, the body having a fluid channel in thermal communication therewith through which a fluid for cooling the container flows.

The fluid channel may comprise at least one groove formed in an outer surface of the mantle. The at least one groove may be a serpentine groove. The mantle may have a generally cylindrical shape, and at least a portion of the at least one groove may extend in a circumferential direction. The mantle may be configured to receive a cover plate for covering the at least one groove. The at least one groove may be adjacent a die end of the mantle. The at least one groove may be formed in an upper portion of the mantle. The mantle may be configured to have a fluid guide mounted thereto, the fluid guide being configured for one or more of: directing fluid into the fluid channel, and directing fluid out of the fluid channel.

In another aspect, there is provided a method of controlling temperature of a container of a metal extrusion press, comprising: flowing fluid through a fluid channel that is in thermal communication with a mantle of the container for cooling the container; and controlling flow rate of the fluid to adjust the temperature of the container.

The method may further comprise controlling thermal energy supplied by at least one heating element accommodated within the mantle.

BRIEF DESCRIPTION OF THE DRAWINGS

Embodiments will now be described more fully with reference to the accompanying drawings in which.

DETAILED DESCRIPTION OF THE EMBODIMENTS

Figure 1:
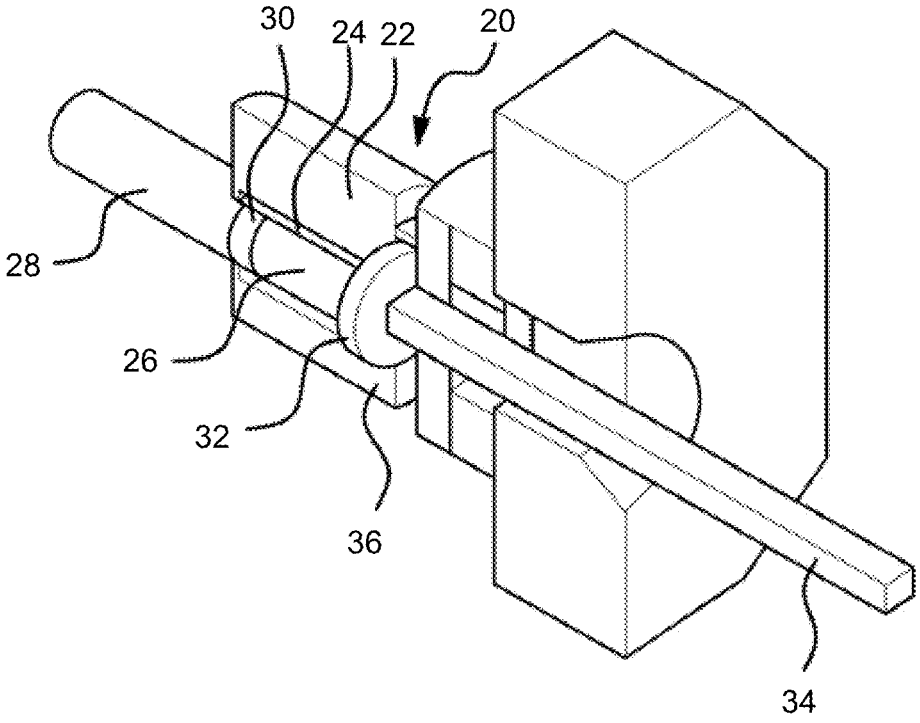
FIG. 1 is a schematic perspective view of a metal extrusion press.
Figure 2:
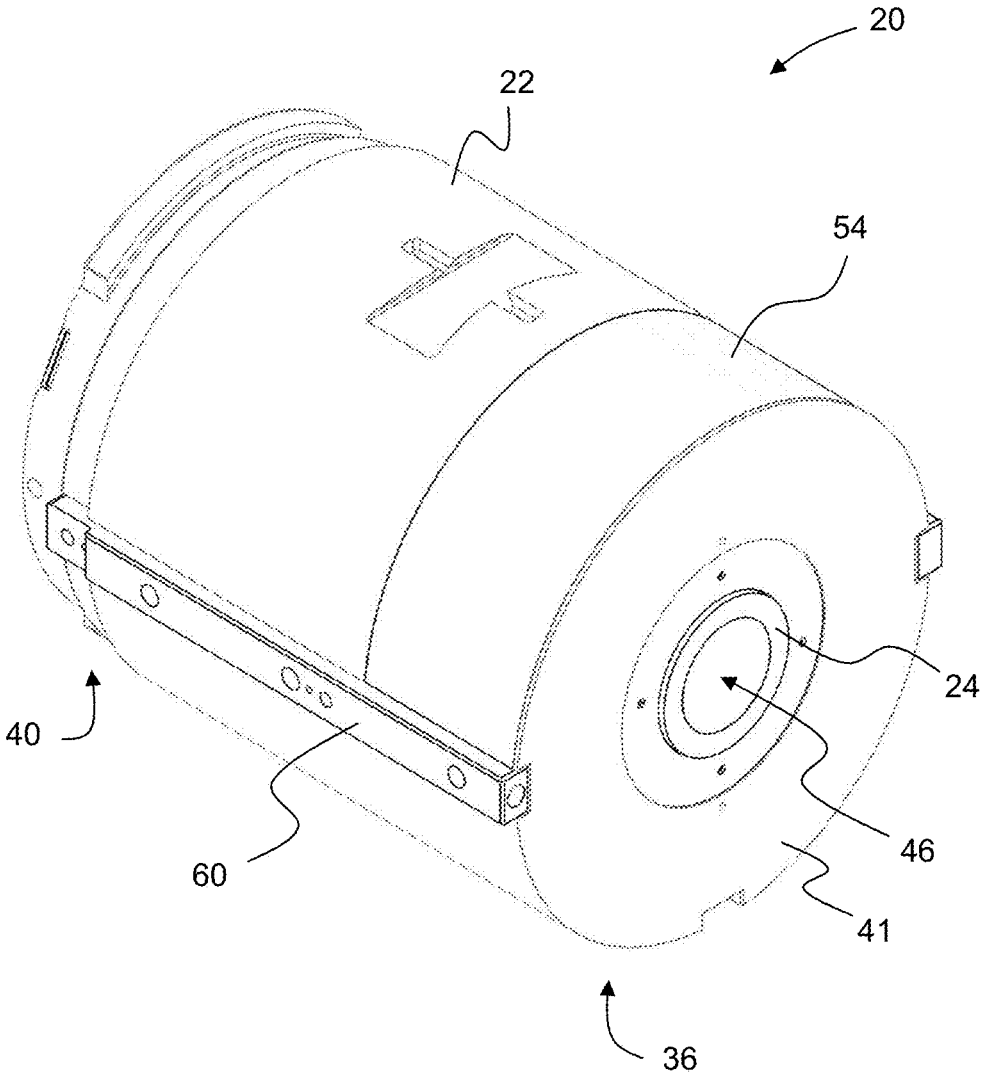
FIG. 2 is a perspective view of a container forming part of the metal extrusion press of FIG. 1.
Figure 3:
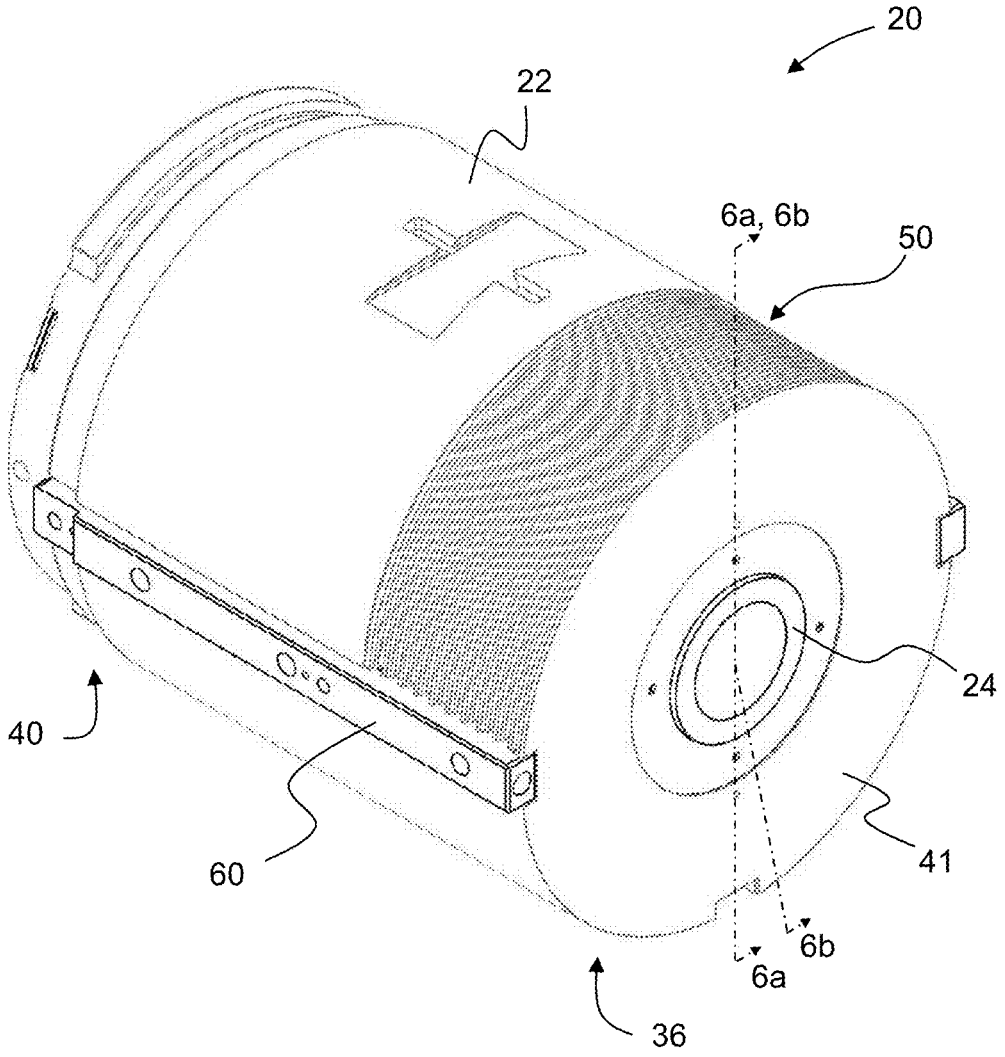
FIG. 3 is a perspective view of the container of FIG. 2, with a cover plate removed therefrom.
Figure 4:
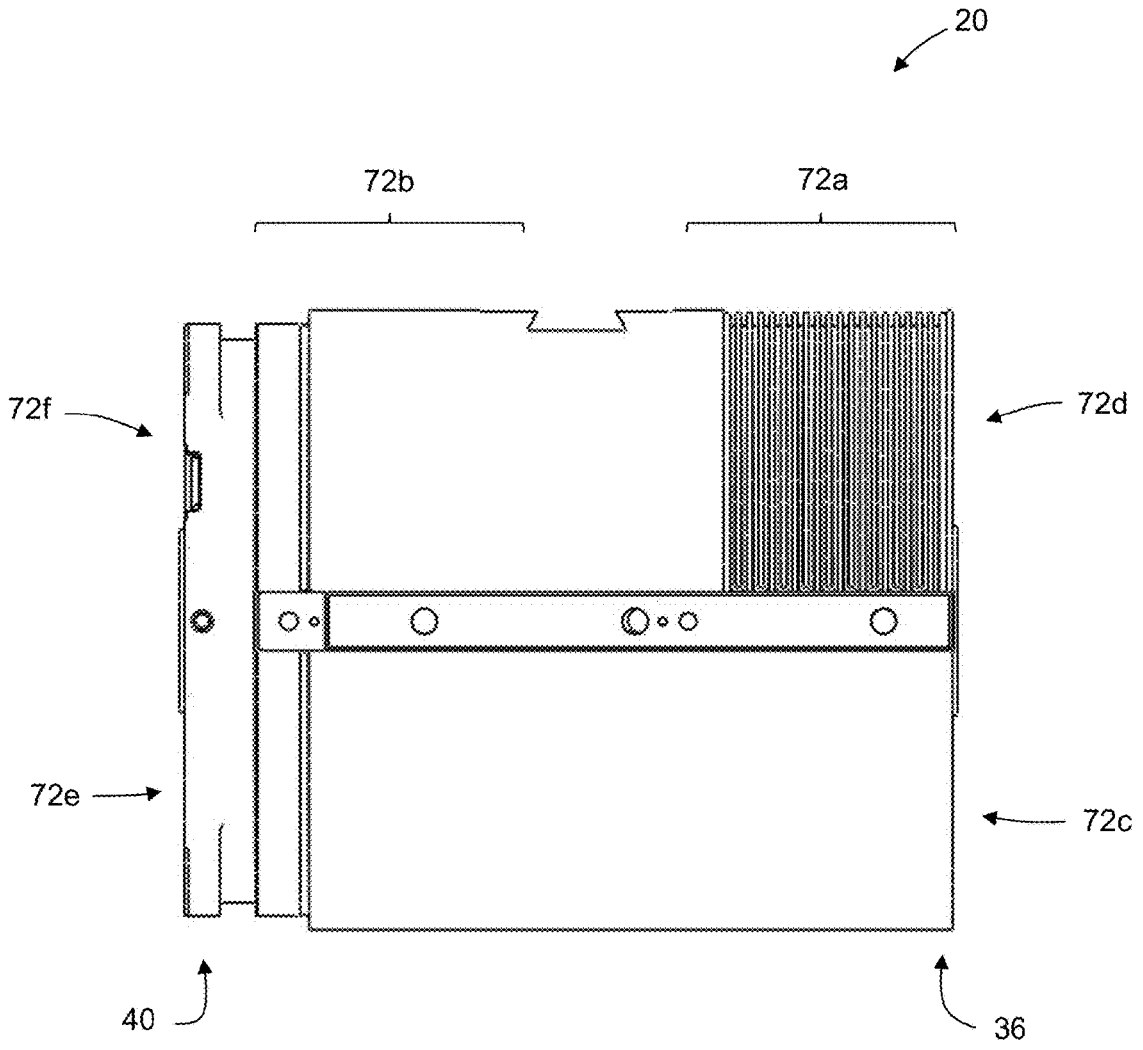
FIG. 4 is an elevational side view of the container of FIG. 3.
Figure 5:
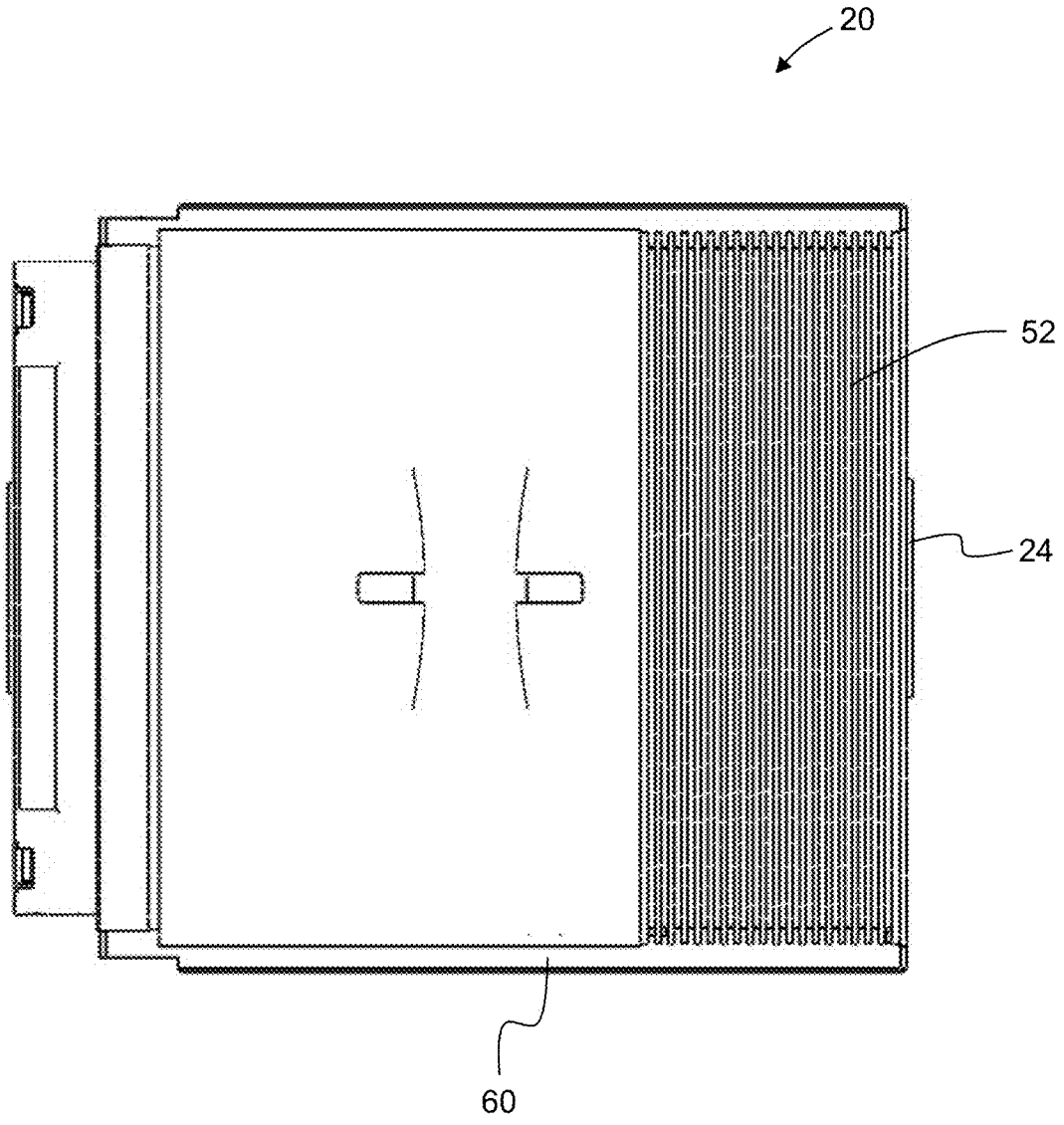
FIG. 5 is a top plan view of the container of FIG. 3.
Figure 6A:
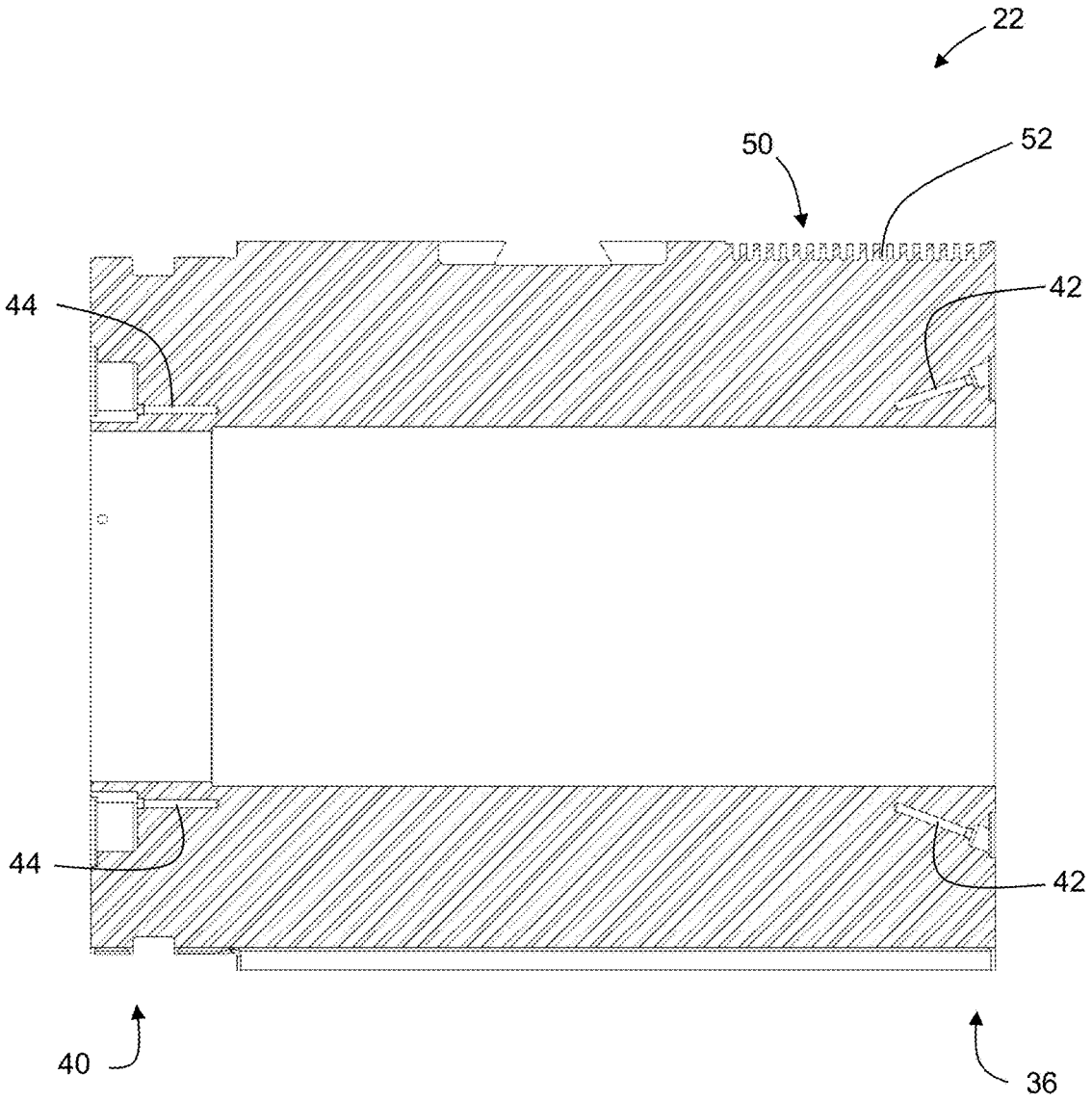
FIGS. 6*a* and 6*b* are side sectional views of a mantle forming part of the container of FIG. 3, taken along the indicated section lines.
Figure 6B:
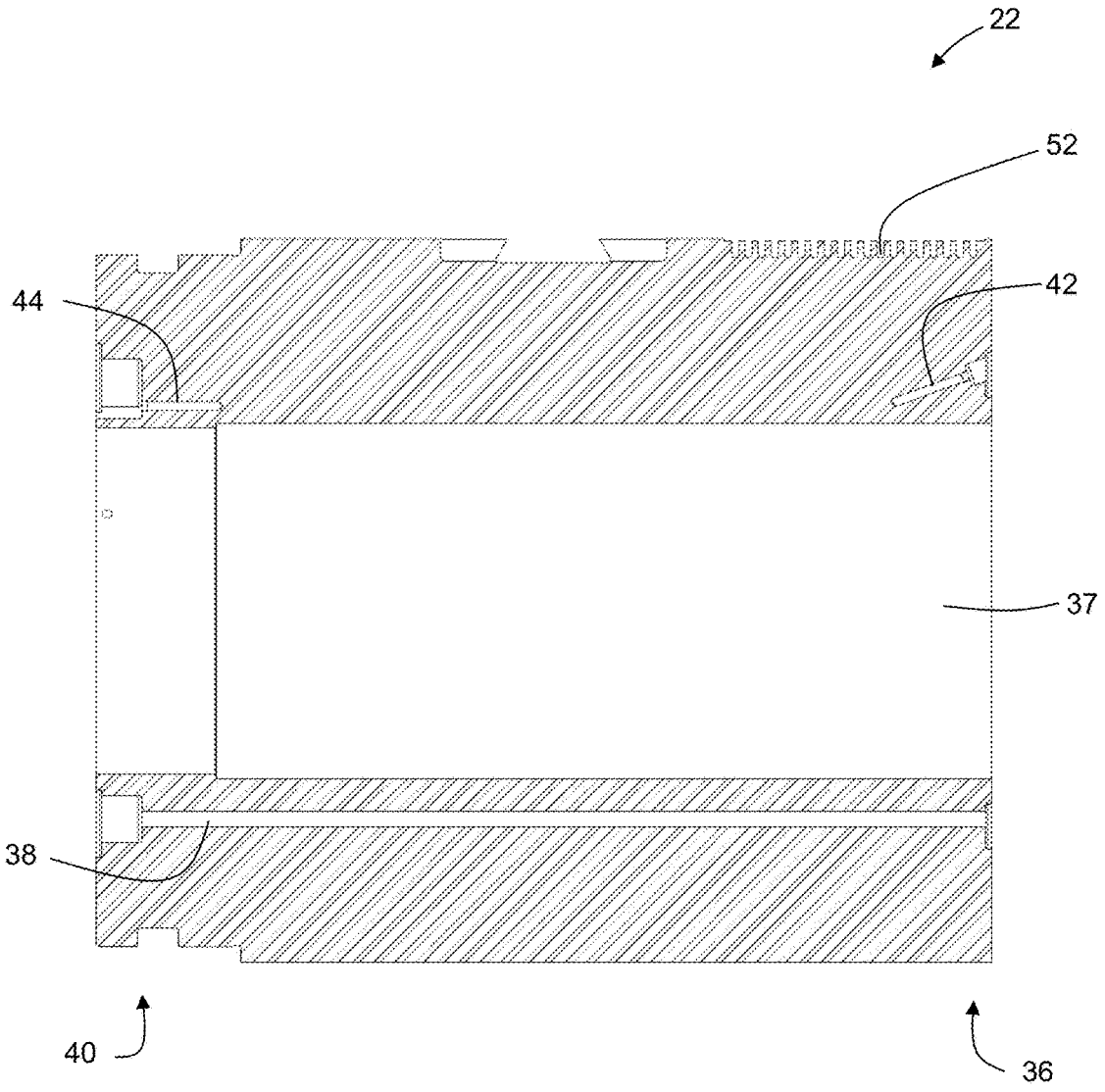
Figure 7:
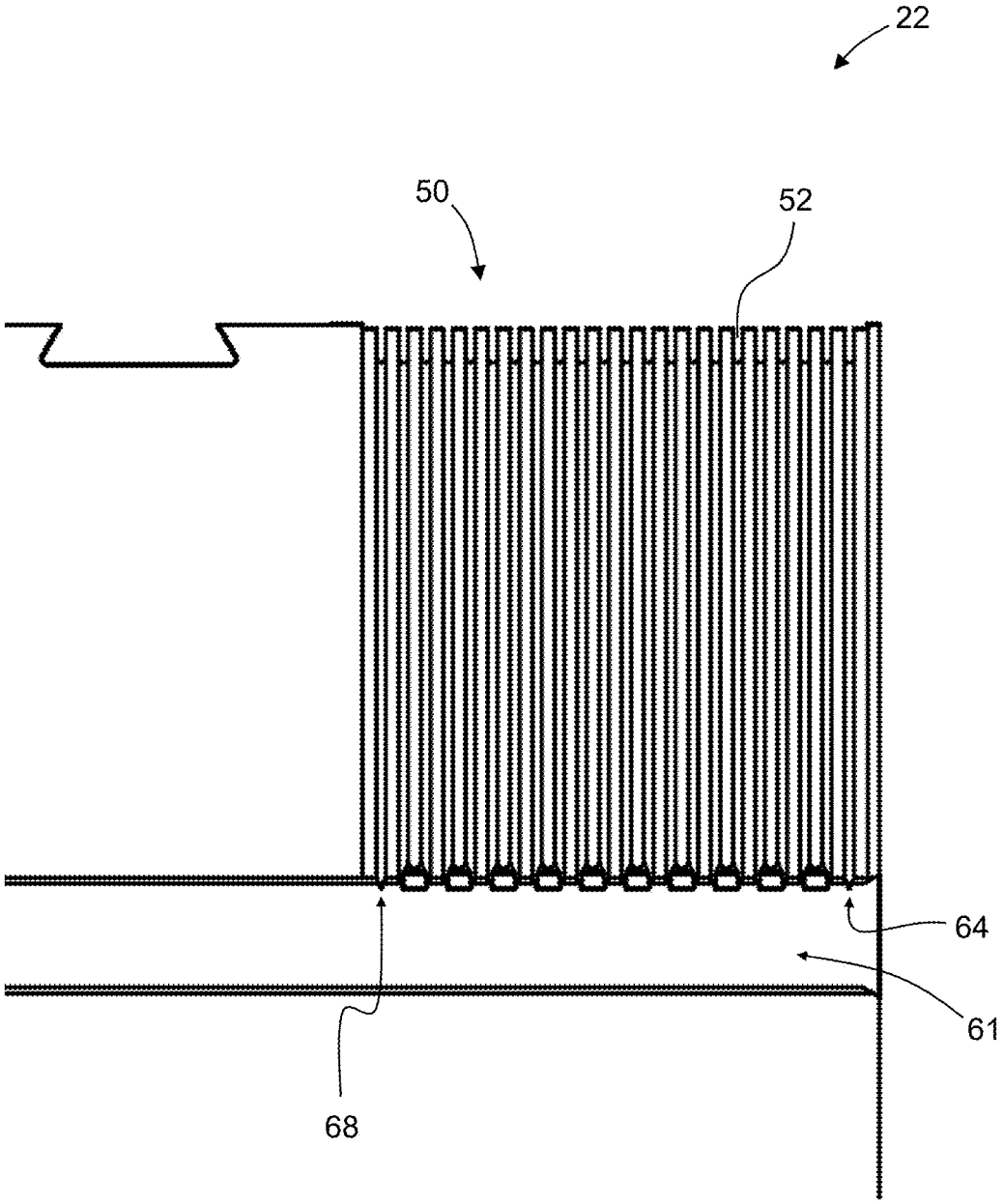
FIG. 7 is an elevational side view of a portion of the mantle.
Figure 8A:
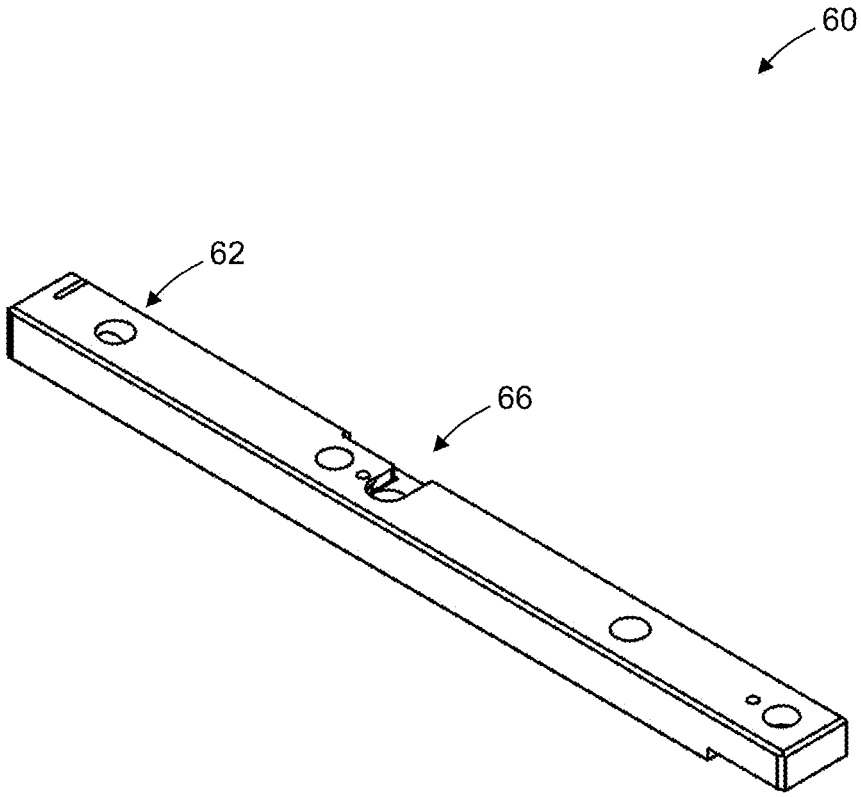
FIGS. 8*a* to 8*c* are rear perspective, rear elevational, and top sectional views, respectively, of a fluid guide forming part of the container of FIG. 2.
Figure 8B:
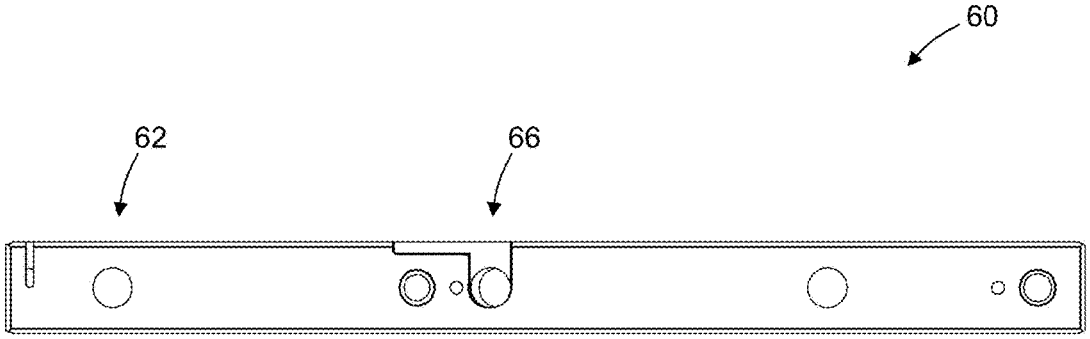
Figure 8C:
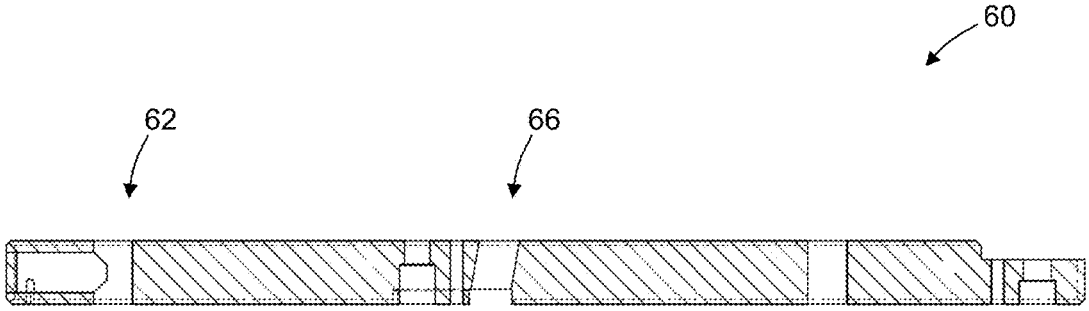

FIG. 1 is a simplified illustration of an extrusion press for use in metal extrusion. The extrusion press comprises a container 20 having an outer mantle 22 that surrounds an inner tubular liner 24. The container 20 serves as a temperature controlled enclosure for a billet 26 during extrusion of the billet. An extrusion ram 28 is positioned adjacent one end of the container 20. The end of the extrusion ram 28 abuts a dummy block 30, which in turn abuts the billet 26 allowing the billet to be advanced through the container 20. An extrusion die 32 is positioned adjacent a die end 36 of the container 20.

During operation, once the billet 26 is heated to a desired extrusion temperature (typically 800-900° F. for aluminum), it is delivered to the extrusion press. The extrusion ram 28 is then actuated to abut the dummy block 30, thereby to advance the billet 26 into the container and towards the extrusion die 32. Under the pressure exerted by the advancing extrusion ram 28 and dummy block 30, the billet 26 is extruded through the profile provided in the extrusion die 32 until all or most of the billet material is pushed out of the container 20, resulting in the extruded product 34.

The container 20 may be better seen in FIGS. 2 to 8. The container 20 is configured at the die end 36, and along the side sections thereof, in a manner known in the art to facilitate coupling of the container 20 to the extrusion press. The mantle 22 has an elongate shape and comprises an axial bore 37 accommodating the liner 24. In this embodiment, the mantle 22 and the liner 24 are shrunk-fit together.

The mantle 22 also comprises a plurality of longitudinal bores 38 extending from the ram end 40 of the mantle 22 to the die end 36 of the mantle 22, and surrounding the liner 24. Each longitudinal bore 38 is shaped to accommodate an elongate heating element, described further below, that can be energized to provide thermal energy to the mantle 22 in the vicinity of the liner 24 during use. The number of longitudinal bores 38 needed depends on the size of the container 20 and on the voltage used to energize the elongate heating elements. In this embodiment, the mantle comprises 22 ten (10) longitudinal bores 38. In the embodiment shown, the container 20 has an end cover plate installed 41 on its die end 36 that covers the ends of the longitudinal bores 38.

The mantle 22 further comprises a plurality of bores 42 and 44 adjacent the liner 24 and extending partially into the length of the mantle 22. In this embodiment, the mantle 22 comprises two (2) bores 42 extending from the die end 36 approximately four (4) inches into the mantle 22, and two (2) bores 44 extending from the ram end 40 approximately four (4) inches into the mantle 22. Each bore 42 and 44 is shaped to accommodate a temperature sensor (not shown). The bores 42 and 44 are positioned in a manner so as to avoid intersecting any of the longitudinal bores 38 configured for accommodating the heating elements. In this embodiment, one (1) of the bores 42 is positioned above the liner 24 while the other bore 42 is positioned below the liner 24, and one (1) of the bores 44 is positioned above the liner 24 while the other bore 44 is positioned below the liner 24.

The liner 24 comprises a billet receiving passage 46 that extends longitudinally therethrough and, in the embodiment shown, the passage 46 has a generally circular cross-sectional profile.

The container 20 also comprises a heat sink that is in thermal communication with the mantle, and which is configured for cooling the container 20. In this embodiment, the heat sink comprises a fluid channel 50 adjacent an upper surface of the container 20 at the die end 36. The fluid channel 50 comprises a circumferentially-oriented, serpentine groove 52 formed in an upper portion of the outer surface of the mantle 22, and a cover plate 54 that is sized to cover the groove 52. When the cover plate 54 is installed so as to cover the groove 52, the fluid channel 50 provides a generally enclosed, continuous channel through which fluid may flow to cool the container 20.

The fluid channel 50 is in fluid communication with a supply of pressurized fluid via an elongate fluid guide 60 accommodated within a longitudinal groove 61 that extends along a side of the mantle 22. The fluid guide 60 comprises an input port 62 that is in fluid communication with a first end 64 of the fluid channel 50, and that is also in fluid communication with a supply of pressurized fluid (not shown) via a supply line (not shown). In this embodiment, the fluid is air. A flow rate control apparatus (not shown) is connected to the supply of pressurized fluid and/or the supply line, and is configured to allow the flow rate of fluid entering the input port 62 to be controlled by an operator. The fluid guide 60 also comprises an output port 66 that is in fluid communication with a second end 68 of the fluid channel 50, and which is also in fluid communication with an exhaust line (not shown).

Figure 9:
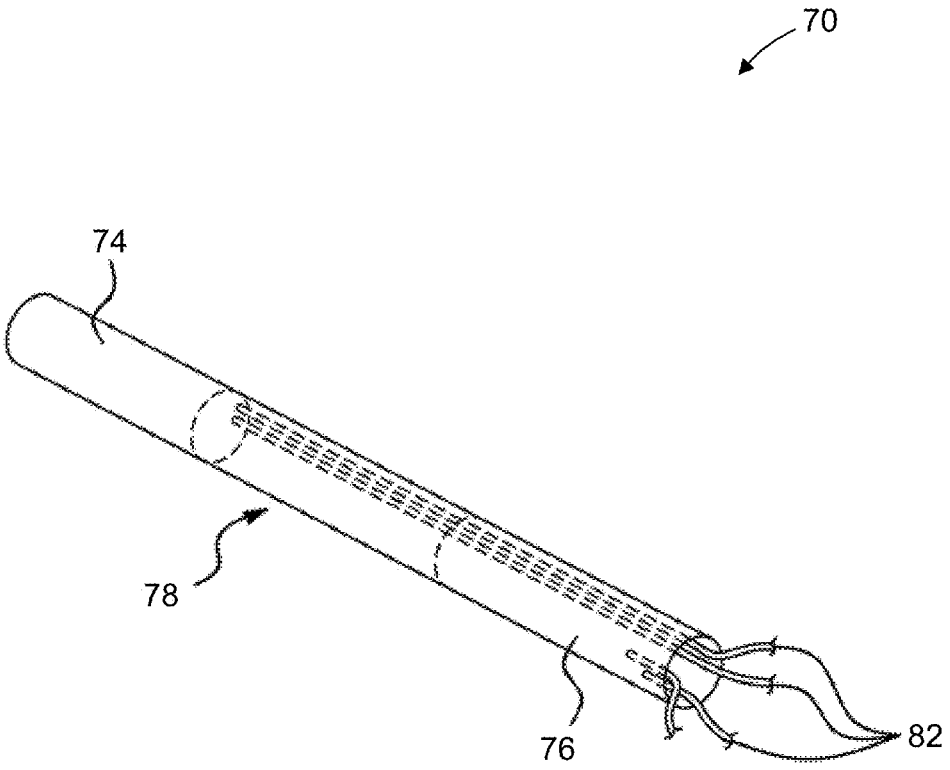
FIG. 9 is a perspective view of a heating element for use with the container of FIG. 2.

FIG. 9 shows one of the elongate heating elements for use with the container 20, and which is generally indicated by reference numeral 70. Heating element 70 is a cartridge-type element. The regions of the container in greatest need of added temperature are generally the die end 36 and ram end 40, referred to as die end zone 72*a* and ram end zone 72*b*, respectively. As such, each heating element 70 may be configured with segmented heating regions. In this embodiment, and as shown in FIG. 9, each heating element 70 is configured with a die end heating section 74 and a ram end heating section 76, which are separated by a central unheated section 78. To energize and control the heating elements, lead lines 82 feed to each heating section 74, 76. The lead lines connect to various bus lines (not shown), which in turn connect to a controller (not shown). The arrangement of the bus lines may take any suitable configuration, depending on the heating requirements of the container 20. In this embodiment, the bus lines are configured to selectively allow heating of the die end zone 72*a* and ram end zone 72*b* of the container, or more preferably just portions thereof, as deemed necessary by the operator. In this embodiment, the arrangement of lead lines enables each of the heating elements 70 to be individually controllable, and also enables each of the heating sections 74, 76 within each heating element 70 to be individually controllable. For example, the operator may routinely identify temperature deficiencies in a lower die end zone 72*c* and a lower ram end zone 72*e*. The elongate heating elements 70 in the vicinity of the lower die end zone 72*c* and the lower ram end zone 72*e* are configured to be controlled by the operator to provide added temperature when required. Similarly, the elongate heating elements 70 in the vicinity of an upper die end zone 72*d* and an upper ram end zone 72*f* are configured to be controlled by the operator to provide reduced temperature when required. It will also be appreciated that the operator can selectively heat zones so as to maintain a preselected billet temperature profile. For example, the operator may choose a billet temperature profile in which the temperature of the billet progressively increases towards the die end, but with a constant temperature profile across the cross-sectional area of the billet. This configuration is generally referred to as a "tapered" profile. Having the ability to selectively heat zones where necessary enables the operator to tailor and maintain a preselected temperature profile, ensuring optimal productivity.

Each temperature sensor (not shown) is configured to monitor the temperature of the container during operation. The positioning of the two (2) bores 42 enables one (1) temperature sensor to be placed in the upper die end zone 72*d*, and one (1) temperature sensor to be placed in the lower die end zone 72*c*. Similarly, the positioning of the two (2) bores 44 enables one (1) temperature sensor to be placed in the upper ram end zone 72*f*, and one (1) temperature sensor to be placed in the lower ram end zone 72*e*. In this embodiment, the sensing elements are thermocouples. The temperature sensors feed into the controller, providing the operator with temperature data from which subsequent temperature adjustments can be made. As will be appreciated, the positioning of temperature sensors in the mantle 22 both above and below the liner 24 advantageously allows the vertical temperature profile across the liner 24 to be measured, and moreover allows any vertical temperature difference that arises during extrusion to be monitored by the operator.

During operation, temperature data output from the temperature sensors is monitored by the operator. The position of the fluid channel 50 advantageously allows any temperature increase within the upper die end zone 72*d* to be reduced or eliminated by increasing the fluid flow rate therethrough. As will be understood, fluid provided by the pressurized fluid supply line enters the first end 64 of the fluid channel 50 via the input port 62 of the fluid guide 60. As the fluid travels along the length of fluid channel 50 to the second end 68, heat is transferred from the mantle 22 to the flowing fluid. The fluid exits from the fluid channel 50 via the output port 66 and enters the exhaust line. As will be appreciated, the transfer of heat from the mantle 22 to the flowing fluid results in a temperature reduction within the upper die end zone 72*d* of the container 20.

Additionally, the positioning of the elongate heating elements also advantageously allows any temperature increase within the upper die end zone 72*d* to be reduced or eliminated by reducing the thermal energy supplied by heating elements 70 positioned above the liner 24. Thus, as each of the heating elements are individually controllable, and as the flow rate of fluid through the fluid channel 50 is also controllable, the thermal profile across the liner 24 and within the container 20 can be accurately controlled. As will be understood, one or both of control of the fluid flow rate through the fluid channel 50, and control of the thermal energy supplied the heating elements, may be used to control the thermal profile across the liner 24 and within the container 20.

It will be understood that the liner is not limited to the configuration described above, and in other embodiments, the liner may alternatively have other configurations. For example, the liner may alternatively comprise a billet receiving passage having a generally rectangular cross-sectional profile that may comprise any of flared ends, rounded corners, and rounded sides, as described in U.S. Application Publication No. 2013/0074568, filed Sep. 17, 2012, entitled "EXTRUSION PRESS CONTAINER AND LINER FOR SAME", the content of which is incorporated by reference herein in its entirety.

Although in the embodiment described above, the fluid channel comprises a circumferentially-oriented, serpentine groove formed in the upper portion of the outer surface of the mantle, in other embodiments, the groove may have other configurations. For example, in other embodiments, the fluid channel may alternatively comprise a longitudinally-oriented, serpentine groove formed in the upper portion of the outer surface of the mantle. Those skilled in the art will understand that still other groove configurations are possible. Additionally, the groove need not necessarily be serpentine, and in other embodiments, the groove may alternatively have a non-serpentine configuration.

Although in the embodiment described above, the longitudinal bores for the elongate heating elements extend the length of the mantle, in other embodiments, the longitudinal bores for the elongate heating elements may alternatively extend only partially the length of the mantle. For example, in one embodiment, the longitudinal bores may alternatively extend from the ram end of the mantle to approximately one-half (0.5) inches from the die end of the mantle.

Although in the embodiment described above, the elongate heating elements are configured with die end heating sections and ram end heating sections, in other embodiments, the elongate heating elements may alternatively be configured with additional or fewer heating sections, and/or may alternatively be configured to heat along the entire length of the heating cartridge.

Although in the embodiment described above, the elongate heating elements in the vicinity of the lower die end zone and the lower ram end zone are described as being configured to be controlled by the operator to provide added temperature, it will be understood that these elongate heating elements are also configured to be controlled by the operator to provide reduced temperature. Similarly, although in the embodiment described above, the elongate heating elements in the vicinity of the upper die end zone and the upper ram end zone are described as being configured to be controlled by the operator to provide reduced temperature, it will be understood that these elongate heating elements are also configured to be controlled by the operator to provide added temperature.

Although in the embodiment described above, the mantle comprises four (4) bores for accommodating temperature sensors, in other embodiments, the mantle may alternatively comprise additional or fewer bores for accommodating temperature sensors.

Although in the embodiment described above, the bores for accommodating temperature sensors extend partially into the length of the mantle, in other embodiments, the bores may alternatively extend the full length of the mantle. In related embodiments, the temperature sensors may alternatively be "cartridge" type temperature sensors, and may alternatively comprise a plurality of temperature sensing elements positioned along their length.

Although in the embodiment described above, the fluid is air, in other embodiments, one or more other suitable fluids may alternatively be used. For example, in other embodiments, the fluid may be any of nitrogen and helium. In other embodiments, the fluid may be cooled by a cooling apparatus prior to entering the fluid channel.

Although in the embodiment described above, the fluid channel comprises a groove formed in an upper portion of the outer surface of the mantle, in other embodiments, other configurations in which the fluid channel is in thermal communication with the mantle are possible. For example, in other embodiments, the fluid channel may alternatively comprise a groove formed in one or more other portions of the outer surface of the mantle. In still other embodiments, the fluid channel may alternatively comprise a fluid channel passing through the interior of the mantle.

Although embodiments have been described above with reference to the accompanying drawings, those of skill in the art will appreciate that variations and modifications may be made without departing from the scope thereof as defined by the appended claims.

What is claimed is:

1. A container for use in a metal extrusion press, the container having a longitudinal axis, the longitudinal axis being oriented generally horizontally and dividing the container into an upper portion and a lower portion when the container is in the use position, the container comprising:

a mantle having an outer surface and an elongate body comprising an axial bore;

an elongate liner accommodated within the axial bore, the liner comprising a longitudinally extending passage through which a billet is advanced; and a fluid channel in thermal communication with the mantle through which a fluid for cooling the container flows, wherein the mantle comprises a plurality of longitudinal bores, each of the bores accommodating a respective heating element, and wherein the fluid channel comprises a continuous serpentine groove formed only in the outer surface of the upper portion of the mantle when the container is in the use position.

2. The container of claim 1, wherein the mantle has a generally cylindrical shape, and wherein at least a portion of the serpentine groove extends in a circumferential direction.

3. The container of claim 1, wherein the fluid channel further comprises a cover plate covering the serpentine groove.

4. The container of claim 1, further comprising a fluid guide configured for one or more of directing fluid into the fluid channel, and directing fluid out of the fluid channel.

5. The container of claim 1, wherein the fluid channel is adjacent a die end of the container.

6. The container of claim 1, wherein the fluid is a gas.

7. The container of claim 6, wherein the gas is air.

8. The container of claim 1, wherein the mantle is configured for connecting to an extrusion press.

9. The container of claim 1, wherein the fluid channel does not circumscribe the mantle.

10. The container of claim 1, wherein the fluid channel comprises at least two adjacent portions in the upper portion of the container that are each configured to direct the fluid in a different respective circumferential direction.

* * * * *